US010934059B2

(12) United States Patent
Wiley et al.

(10) Patent No.: US 10,934,059 B2
(45) Date of Patent: Mar. 2, 2021

(54) STORAGE TRAY BAG FOR PREPARED FOOD ITEM AND METHOD OF USE

(71) Applicants: Raymond Hoffman Wiley, Xenia, OH (US); Kelly Eileen Gray, Xenia, OH (US)

(72) Inventors: Raymond Hoffman Wiley, Xenia, OH (US); Kelly Eileen Gray, Xenia, OH (US)

( * ) Notice: Subject to any disclaimer, the term of this patent is extended or adjusted under 35 U.S.C. 154(b) by 328 days.

(21) Appl. No.: 15/993,848

(22) Filed: May 31, 2018

(65) Prior Publication Data

US 2019/0367220 A1 Dec. 5, 2019

(51) Int. Cl.
*B65D 33/01* (2006.01)
*B65D 35/10* (2006.01)

(52) U.S. Cl.
CPC ..... *B65D 35/10* (2013.01); *B65D 33/01* (2013.01); *B65D 2565/381* (2013.01)

(58) Field of Classification Search
CPC ..... B65D 25/16; B65D 2565/00; B65D 2565/38; B65D 2565/381; B65D 65/02; B65D 65/10; B65D 65/12; B65D 33/01; A47J 36/16
See application file for complete search history.

(56) References Cited

U.S. PATENT DOCUMENTS 5,613,427 A * 3/1997 Wiley ..... A21B 3/131 99/446
2005/0013951 A1* 1/2005 Mitchell ..... A47J 36/022 428/34.2

* cited by examiner

*Primary Examiner* — Andrew T Kirsch
(74) *Attorney, Agent, or Firm* — R. William Graham

(57) ABSTRACT

A disposable food bag for use with a food tray which has a base of a predetermined length L and a width W, a wall extending upward from the base of a predetermined height H forming a container to provide a predetermined depth D and having a upper perimeter lip, wherein the bag includes a plastic substrate of length L1 which is slightly larger than length L and a width W1 which is slightly larger than width W and has an outer portion is configured to be retained by the perimeter lip, and an inner portion which when the outer portion is so retained has a depth D1 approximately the depth D and has at least one vent opening disposed within the inner portion.

15 Claims, 6 Drawing Sheets

STORAGE TRAY BAG FOR PREPARED FOOD ITEM AND METHOD OF USE

BACKGROUND OF THE INVENTION

This invention relates generally to storage of food items. More particularly, the invention relates to more efficient storage of prepared food items, such as raw or uncooked pizza pie dough, in a manner to maintain the food item in a spaced relation from an adjacent food item. The invention has great application to devices as are used in the commercial production of food items, such as pizza pies, wherein a large number of such for items are made by mass production methods. There is still a need at this time for improved handling of many food items at a same time, such as during the stage when the pizza pie yeast dough are left to rise, so that this handling may be done more quickly, efficiently and ensuring a higher level of food safety, thus resulting in greater production at lower cost so as to increase profits.

PRIOR ART

There currently exist many devices for storing food items. These include various trays and dishes, some of these with nesting features and various lids and closure mechanisms. In the field of mass production of food items, there is employed a number of pans or trays containing food items, such as dough which may be kept during a dough rising period. One system holds the tray on a wheeled cart to be easily moved between an area where the dough is initially kneaded, and a heated area where the kneaded dough is then left to rise prior to removal therefrom and transported to a place for final kneading and prepared for baking. In that system, the trays employed are required to be washed and cleaned after each use. This is time consuming and expensive.

SUMMARY OF THE INVENTION

It is an object to improve storage of prepared food items.

It is another object to provide a method of storage raw or uncooked items in a manner to reduce time and expense associated with cleaning food containers.

A further object is to provide a dough rising tray stacking device with a dough bag over each tray containing dough during a dough rising period, each bag holding the dough conveniently stacked in minimum space and the device being spaced to be easily moved between an area where the dough is initially kneaded and a heated area where the kneaded dough is then left to rise prior to removal therefrom and transported to a place for final kneading and prepared for baking.

Another object accordingly is to provide a dough rising bag and tray stacking device which is suitable for use by an establishment that prepares initially raised dough for a plurality of pizza pies and which is then delivered to individual pizza pie restaurants or pizza pie stands for selling to individual customers.

Still another object is to provide a dough rising bag and tray stacking device which is suitable for handling rising dough for breads or other pastries besides pizza pie crusts.

A further object is to provide an easy to use product and system to increase food safety within restaurant, such as a pizza restaurant, operations by providing a disposable pizza dough tray/dough box liner that maintains the quality of the product stored on the liner bags and reduces bacteria transfer from unclean dough trays to the dough balls stored thereon.

Accordingly, one aspect of the instant invention is directed to a disposable food bag, and tray for use therewith. The disposable food bag is configured for a food tray having a base of a predetermined length L and width W, a wall extending upward from the base of a predetermined height H forming a container to provide a predetermined depth D. The wall has connected an upper extending perimeter lip having a predetermined length PL and predetermined width PW. The bag includes a plastic substrate which has a length L1 which is slightly larger than length PL and a width W1 which is slightly larger than width PW and is configured to be retained by the wall at the perimeter lip. The bag has a depth D1 approximately the depth D and has at least one vent opening disposed located in an inner portion of the bag adjacent an outer portion of the bag retained by the perimeter lip. When so retained on the tray, the vent is located adjacent inside of the wall. The bag is made of a food grade plastic material which is BPA free and of sufficient strength to be maintained stretched over the wall with minimal movement once the food item(s) are disposed thereon.

Another aspect of the invention relates to a system for handling uncooked items in a manner which provides an easy to clean and improved storage container. The system includes employing a food tray having a base of a predetermined length L and width W, a wall extending upward from the base of a predetermined height H to provide a predetermined depth D, providing a bag includes a plastic substrate which has length L1 which is slightly larger than length PL and width W1 which is slightly larger than width PW and has an outer portion of the bag configured to be retained by the wall at a laterally extending perimeter lip, and when the outer portion is retained on the wall an inner portion of the bag is within the perimeter lip and extends a depth D1 approximately the depth D and has at least one vent opening disposed within an inner portion of the bag located adjacent the outer portion within the perimeter lip. The bag operatively is disposed over the tray in a manner to be maintained stretched over the wall with minimal movement once one or more food item(s) is disposed thereon, and disposing at least one food item on the inner portion of the bag. The system is further characterized to include placing a plurality of food items on the bag in a spaced manner from one another. The system further is characterized such that the uncooked food items are of an expanding nature.

Further objects of the invention will be apparent from the description which follows.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF PREFERRED EMBODIMENT

Figure 1:
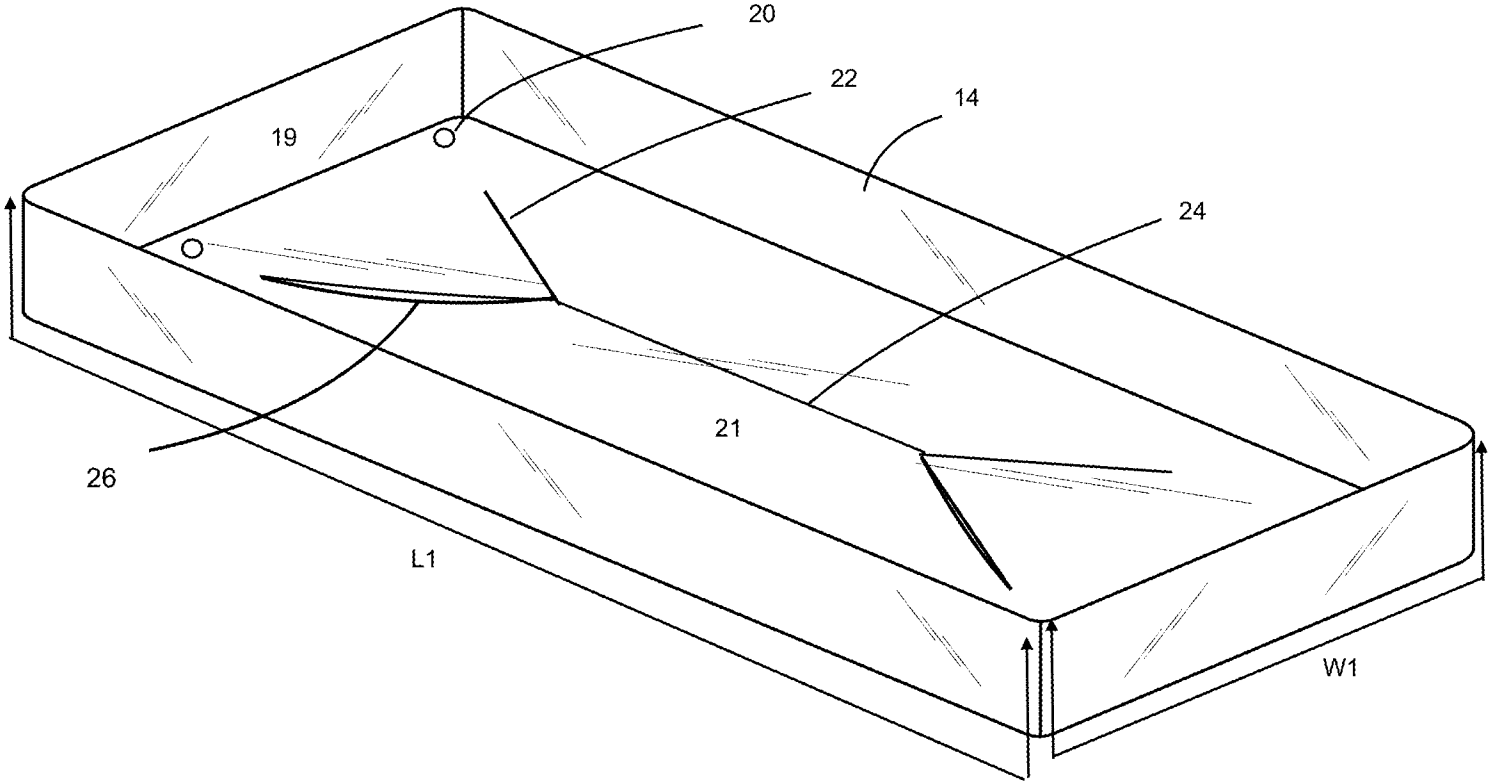
FIG. 1 is a perspective view of a bag of the invention with an outer portion shown in erect manner.
Figure 2:
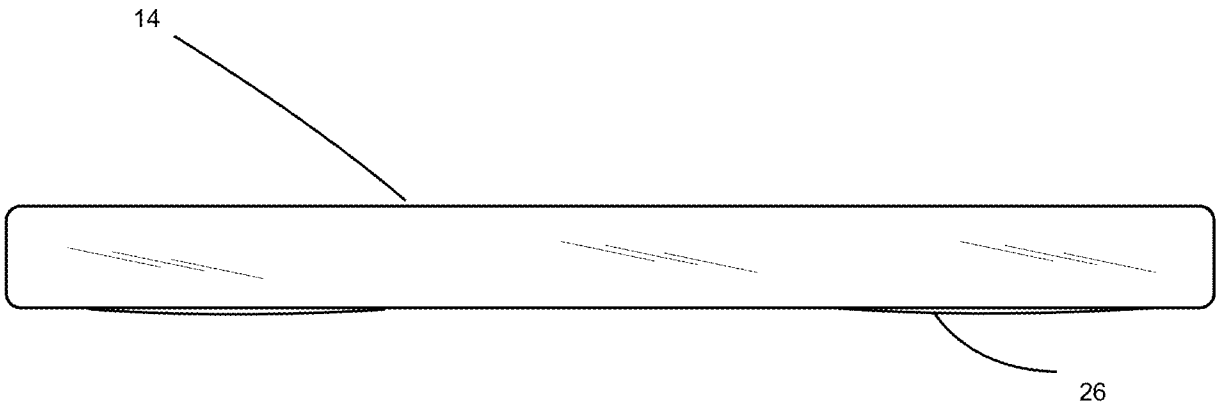
FIG. 2 is a left side view of the bag in FIG. 1.
Figure 3:
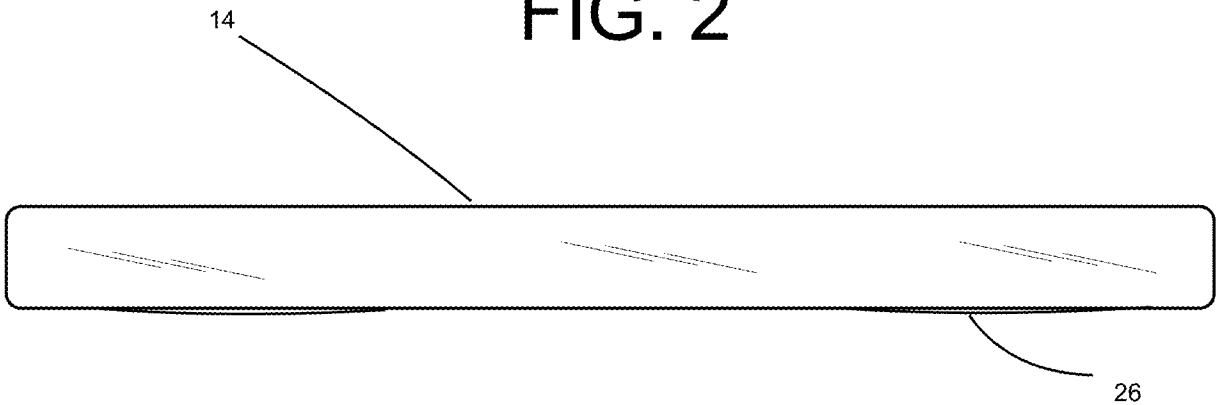
FIG. 3 is a right side view of the in FIG. 1.
Figure 4:
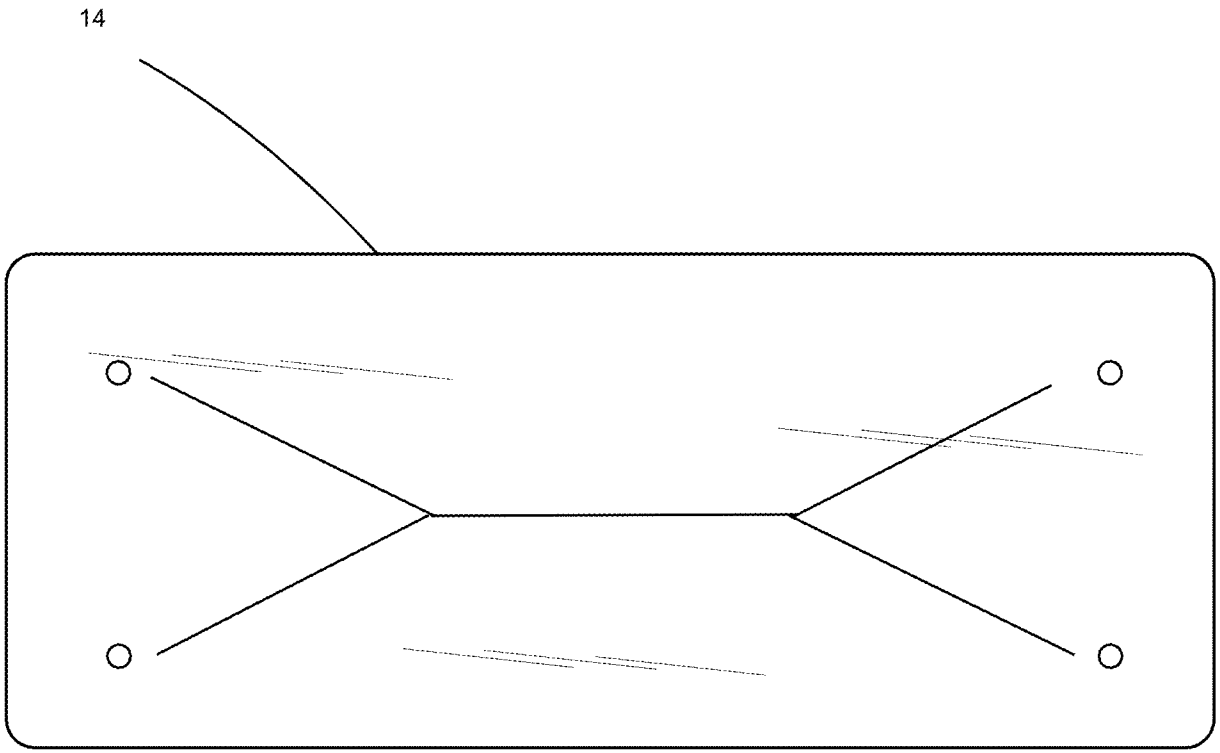
FIG. 4 is a top view of the bag in FIG. 1.
Figure 5:
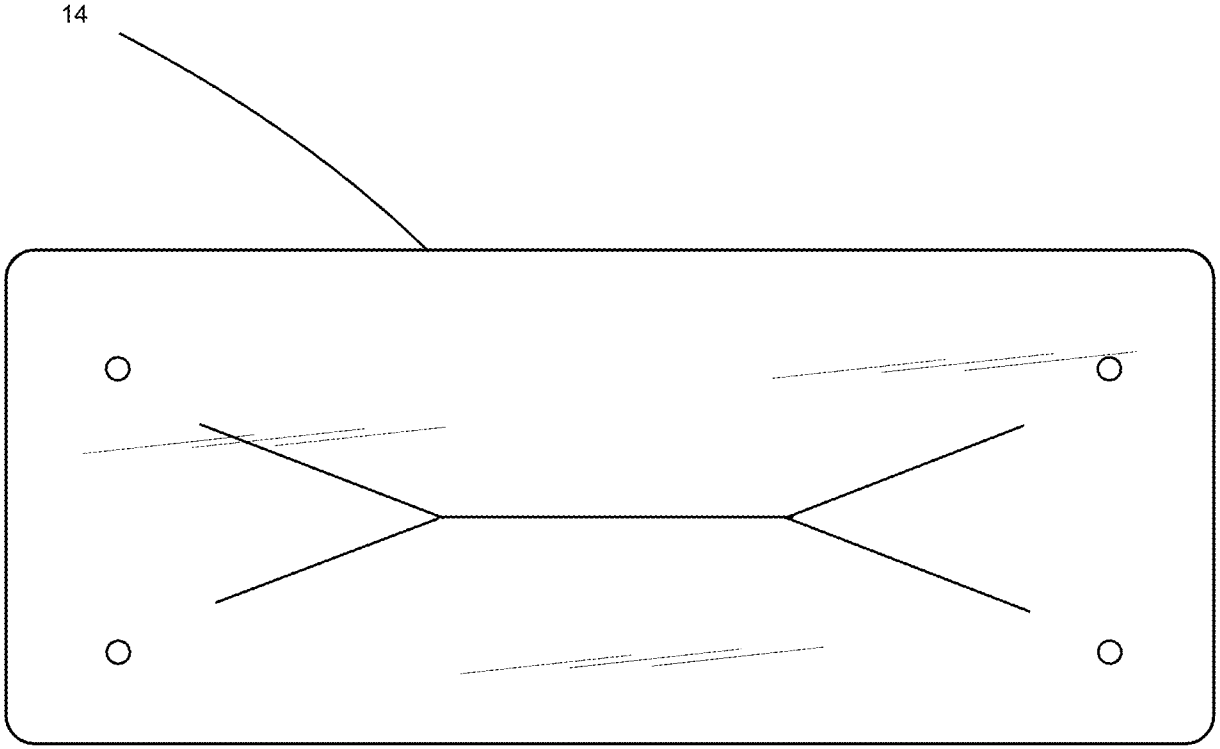
FIG. 5 is a bottom view of the bag in FIG. 1.
Figure 7:
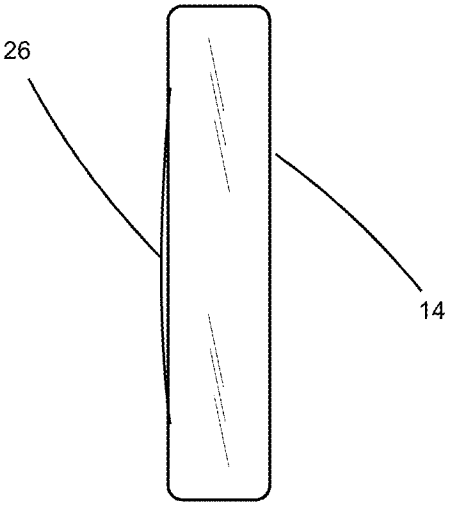
FIG. 7 is a back end view of the bag in FIG. 1.
Figure 6:
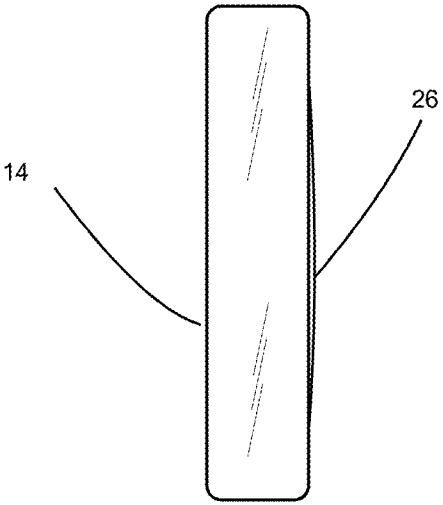
FIG. 6 is a front end view of the bag in FIG. 1.
Figure 8:
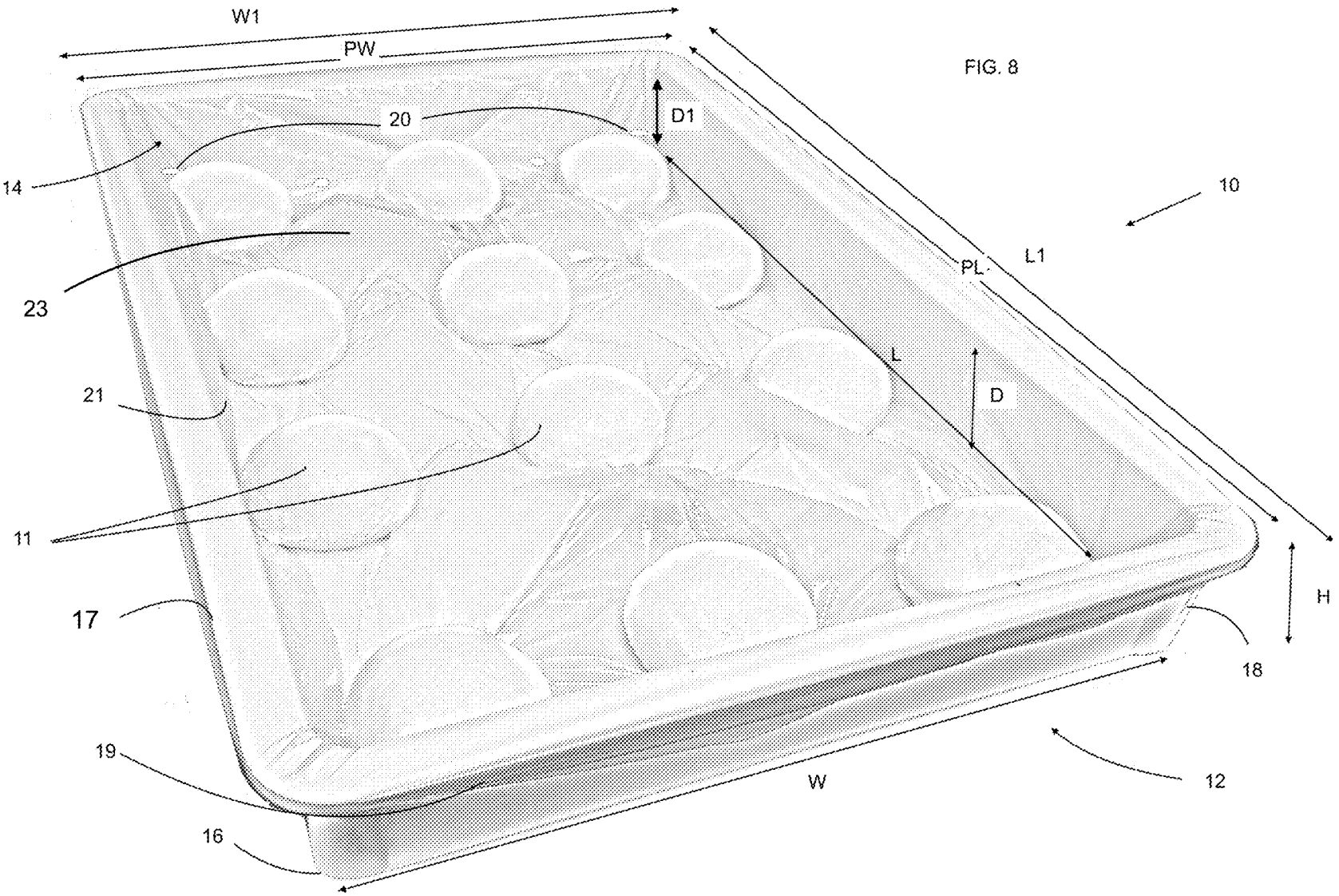
FIG. 8 is a perspective view of a bag and tray of the invention.

Referring now to the drawings in greater detail, the dough rising bag and tray stacking container of the instant invention is generally designated by the reference numeral 10. By way of example, the instant invention is particularly well suited for solving the problems in mass production of a certain raw or uncooked food item(s) 11 such as rising dough, which is currently stacked in rising pan stacking device for preparing pizza pie crust, however, it is contemplated that this invention can apply to other areas such as cookie dough or other items requiring maintaining of a spaced relation during the handling of the item 11 and tray 12 during the mass production of such items.

The invention provides a disposable food bag 14 for use with tray 12. The design of the instant bag 14 is preferably an FDA compliant plastic bag liner, designed for increased food safety and simplification of operations which is excellent in various applications, such as when using pizza dough boxes or pizza dough trays.

The disposable food bag 14 is configured for the food tray 12 which has a base 16 of a predetermined length L and a predetermined width W, a wall 18 extending upward from the base 16 of a predetermined height H to provide a predetermined depth D and connected to the wall 18 is an upper laterally extending perimeter lip 17 having a predetermined length PL and predetermined width PW. The bag 14 includes a plastic substrate which has a length L1 which is slightly larger than length PL and width W1 which is slightly larger than width PW and is configured to be retained by the wall 18 at the perimeter lip 17. The bag 14 has an outer portion 19 retained on the perimeter lip 17 providing an inner portion 21 extending a depth D1 approximately the depth D. The bag 14 has at least one vent opening 20 disposed within the inner portion 21 located adjacent the outer portion 19 within the perimeter lip 17. When the bag 14 is disposed over the wall 18 in a self retaining manner, the vent opening 20 is preferably located adjacent an inside of the wall 18. The bag 14 has seams 22 and 24 which provide a desired configuration and a resulting fold area 26. The bag 14 can be made of a food grade plastic material which is BPA free and of sufficient strength to be maintained stretched over the perimeter lip 17 of the wall 18 with minimal movement once the food item(s) 11 are disposed thereon.

Another aspect of the invention relates to a system for handling uncooked item(s) 11 in a manner which provides an easy to clean and improved storage container 10. The system includes employing the food tray 12 having as described above having base 16 of predetermined length L and predetermined width W, wall 18 extending upward from the base 16 of predetermined height H to provide a predetermined depth D, providing bag which includes a plastic substrate 14 of length L1 slightly larger than length PL and width W1 which is slightly larger than width PW configured to be retained by the perimeter lip 17, more specifically an outer portion 19 of the bad 14 is retained thereon and an inner portion 21 of the bag 14 extends depth D1 approximately the depth D within the wall 18 and has at least one vent 20 opening disposed within the inner portion 21. Further, the system includes operatively disposing the bag 14 over the tray 12 it in a manner to be maintained stretched over and retained by the peripheral lip 17 with minimal movement when one or more food item(s) is disposed thereon and thus forming a container 10. At least one food item 11 is disposed on the inner portion 21 on the bag 14. The system is further characterized to include placing a plurality of items 11 on the inner portion 21 of the bag 14 in a spaced manner from one another. The method further is characterized such that the raw or uncooked food items 11 are dough.

A further aspect is to create a plurality of like formed containers 10 each having a plurality of items 11 on each inner portion 21 of each bag 14 forming a pouched area between each item 11 wherein the items 11 are in a spaced manner from one another to aid in retention of spatial position of the items and wherein each tray 12 is configured to be stack in a nested relation in an upright manner upon a horizontal manner. These containers 10 are typically supported by a mobile cart in order that it may be conveniently moved between a place where individual item 11 (yeast dough pieces or item of an expanding nature) are initially formed and a place where the dough are left to use, and finally to a place where the risen dough are then prepared for baking.

While the above description relates to particular for items, such as pizza dough, it is readily understood that this device may alternately serve for rising dough to make breads or another rising pastry. In use, the invention 10 may be used for delivery of rising dough from a primary dough making establishment to several retail stores selling the finished pizza pie or the like. The containers 10 may be shipped in a truck between locations without risk of shifting of the food items 11 and thus preventing the contacting of adjacent items 11 and thus preventing waste.

The tray 12 is shown as rectangular and the bag 14 configured to fit the same, but it is recognized that these may be made in any shape and configured accordingly, for handling more or less food items. By virtue of the invention, there is provided a disposable plastic product that can be used with a variety of commercially available pizza dough boxes/dough trays and is used to decrease the possibility of bacteria and contamination by restaurant operators serving pizza to the public. The bag 14 is be installed easily on to (into) a dough box/dough tray 12, simply by stretching the bag 14 over the perimeter edges of the tray 12. The bags 14 are made from FDA approved, food grade plastic. The bag 14 is engineered to fit tray 12 snuggly, preventing item 11 (dough) from sliding around during tray movement. Vent holes 20 in the bag 14 can preferably located in the bag 14 so the holes 20 are adjacent inside corners of the tray 12, to allow trapped air to escape, making the bags easier and quicker to install. Once bag 14 is installed, a light mist of anti-stick or release spray material (PAM™ or equal) is recommended to be sprayed on the bag 14 to prevent food items (dough balls) from sticking to the bag 14. Bags are a single use, disposable product, designed to save time, labor and money.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A disposable food bag for use with a food tray, the food tray having a base of a predetermined length L and a width W, a wall extending upward from the base of a predetermined height H forming a container to provide a predetermined depth D and has an upper perimeter lip having predetermined length PL and predetermined width PW, which includes:

a plastic substrate of length L1 which is slightly larger than length PL and a width W1 which is slightly larger than width PW and has an outer portion which is configured to be retained by the perimeter lip in a stretched manner, and an inner portion which when said outer portion is so retained on the perimeter lip extends within the wall and has a depth D1 approximately the depth D and has at least one vent opening disposed within said inner portion and said inner portion configured to receive one or more item thereon in a manner which does not cover said vent and upon receipt of said item forms a pouched portion thereabout to aid in preventing movement of said item.

2. The disposable food bag for use with a tray a food tray of claim 1, wherein said vent is located adjacent said outer portion.

3. The disposable food bag for use with a tray a food tray of claim 1, wherein said bag is made of a food grade plastic material which is BPA free.

4. The disposable food bag for use with a tray a food tray of claim 1, wherein said bag is of sufficient strength to be maintained stretched over the perimeter lip of said wall with minimal movement of said outer portion once the food item is disposed thereon.

5. A disposable food bag and tray for use therewith which includes:

a food tray having a base of a predetermined length L and a width W, a wall extending upward from the base of a predetermined height H forming a container to provide a predetermined depth D and having an upper perimeter lip having predetermined length PL and predetermined width PW;

a plastic substrate of length L1 which is slightly larger than length PL and a width W1 which is slightly larger than width PW and has an outer portion which is configured to be retained by said wall at said perimeter lip in a stretched manner, and an inner portion which when said outer portion is so retained on said wall has a depth D1 approximately said depth D and has at least one vent opening disposed within said inner portion and said inner portion configured to receive one or more item thereon in a manner which does not cover said vent and upon receipt of said item forms a pouched portion thereabout to aid in preventing movement of said item.

6. The disposable food bag and tray for use therewith of claim 5, wherein said vent is located adjacent said outer portion.

7. The disposable food bag and tray for use therewith of claim 5, wherein said bag is made of a food grade plastic material which is BPA free.

8. The disposable food bag and tray for use therewith of claim 5, wherein said bag is of sufficient strength to be maintained stretched over the wall with minimal movement of said outer portion once the food item is disposed thereon.

9. A system for handling uncooked items in a manner which provides an easy to clean and improved storage container, which includes:

employing a food tray having a base of a predetermined length L and width W, a wall extending upward from the base of a predetermined height H to provide a predetermined depth D and an upper perimeter lip having predetermined length PL and predetermined width PW;

providing a bag has length L1 which is slightly larger than length PL and width W1 which is slightly larger than width PW and has an outer portion of the bag configured to be retained by the perimeter lip in a stretched manner, and when the outer portion is retained an inner portion of the bag is within the wall and extends a depth D1 approximately the depth D and the bag has at least one vent opening disposed within said inner portion and said inner portion configured to receive one or more item thereon in a manner which does not cover said vent;

operatively disposing the bag over the tray in a manner to be maintained stretched over the perimeter lip in a self retained manner with minimal movement thereof; and disposing at least one food item on the inner portion of the bag within the perimeter and in a manner to avoid covering said at least one vent to permit trapped air under the inner portion to escape and upon receipt of said item forms a pouched portion thereabout the item to aid in preventing movement thereof.

10. The system of claim 9, which includes spraying the bag with an anti-stick spray material.

11. The system of claim 10, which is further characterized to include placing a plurality of food items on the bag in a spaced manner from one another.

12. The system of claim 9, which is further characterized to include placing a plurality of food items on the bag in a spaced manner from one another and characterized to have at least one pouched portions between adjacent food items.

13. The system of claim 9, which is further characterized such that the uncooked food items are of an expanding nature.

14. The system of claim 13, wherein the items include dough.

15. The system of claim 9, which includes removing the food item and bag from the tray and repeating then steps of claim 9.

* * * * *